US005503798A

United States Patent [19]

Singheiser et al.

[11] Patent Number: 5,503,798

[45] Date of Patent: Apr. 2, 1996

[54] HIGH-TEMPERATURE CREEP-RESISTANT MATERIAL

[75] Inventors: Lorenz Singheiser, Heidelberg; Richard Wagner; Peter Beaven, both of Reinbeck; Heinrich Mecking, Buchholz, all of Germany; Jiansheng Wu, Shanghai, China

[73] Assignees: ABB Patent GmbH, Mannheim; GKSS-Forschungszentrum Geesthacht GmbH, Geesthacht, Germany

[21] Appl. No.: 228,684

[22] Filed: Apr. 18, 1994

Related U.S. Application Data

[63] Continuation-in-part of Ser. No. 59,491, May 10, 1993, abandoned.

[30] Foreign Application Priority Data

May 8, 1992 [DE] Germany ..... 42 15 194.5

[51] Int. Cl.[6] ..... C22C 14/00

[52] U.S. Cl. ..... 420/420; 420/418; 148/421

[58] Field of Search ..... 420/418, 420; 148/421

[56] References Cited

U.S. PATENT DOCUMENTS

| | | | |
|---|---|---|---|
| 3,411,901 | 11/1968 | Winter | 420/418 |
| 4,292,077 | 9/1981 | Blackburn et al. | 148/11.5 F |
| 4,983,357 | 1/1991 | Mitao et al. | 420/418 |
| 5,183,635 | 2/1993 | Kerry et al. | 420/418 |
| 5,190,602 | 3/1993 | Bendersky et al. | 148/669 |
| 5,196,162 | 3/1993 | Maki et al. | 420/418 |

FOREIGN PATENT DOCUMENTS

| | | |
|---|---|---|
| 1245136 | 7/1967 | Germany . |
| 3257130 | 11/1991 | Japan . |

OTHER PUBLICATIONS

Japanese Patent Abstract 3 226 538 Mar. 1991.

DE–Z "Metallkunde" vol. 65, No. 2, Dec. 1974, pp. 89–93.

*Primary Examiner*—Scott Kastler

[57] ABSTRACT

A multiphase, high-temperature material contains an intermetallic base alloy of the $Ti_3Al$ type, which is intended especially for use in heat engines such as internal combustion engines, gas turbines and aircraft engines. The material contains from 44 to 73 atom % titanium, from 19 to 35 atom % aluminum, from 2 to 6 atom % silicon, and from 5 to 15 atom % niobium. The desired microstructure is attained by heat treating the alloy at between 800° and 1100° C.

7 Claims, No Drawings

HIGH-TEMPERATURE CREEP-RESISTANT MATERIAL

CROSS-REFERENCE TO RELATED APPLICATION

This is a continuation-in-part of application Ser. No. 08/059,491, filed May 10, 1993, now abandoned.

BACKGROUND OF THE INVENTION

FIELD OF THE INVENTION

The invention relates to a multiphase high-temperature material made from an alloy on the basis of an intermetallic compound of the $Ti_3Al$ type, especially for use in heat engines such as internal combustion engines, gas turbines and aircraft engines.

The development of heat engines is increasingly directed towards higher outputs while keeping to the same size as far as possible, resulting in a steady increase in the thermal stress of the individual components, so that the materials being used are increasingly required to be both more heat-proof and stronger.

In addition to numerous developments in the materials sector, for example nickel-based alloys, alloys which are on the basis of an intermetallic compound of the $Ti_3Al$ type, in particular, have attracted increasing interest with regard to such use in heat engines, because of the high melting point combined with low density. Numerous developments deal with the attempt to improve the mechanical properties of such high-temperature materials. Those developments, in addition to improving the mechanical properties, especially address the resistance to corrosive attack at high service temperatures, for example resistance to the attack of hot combustion gases, gaseous chlorides and sulphur dioxide.

Moreover, at lower temperatures the useful life is limited by condensed alkali metal sulphates and alkaline earth metal sulphates, preventing full utilisation of the per se available strength potential of such materials. In other words, the service temperature which could be achieved, in terms of high-temperature creep resistance per se, is reduced due to the limited oxidation resistance.

It is sufficiently well known that the oxidation resistance of the binary titanium/aluminum compounds is completely inadequate for the applications mentioned above, since the oxidation rate is several powers of ten higher than that of superalloys used at present, and their oxide layers have low adhesion, which results in steady corrosive erosion. It is known that compounds on a titanium aluminide basis having significant proportions of chromium and vanadium do exhibit good oxidation resistance at temperatures above 900° C., which is comparable with that of superalloys used at present, but that oxidation behavior at lower temperatures is completely inadequate, comparable with that of binary titanium aluminides, e.g. $Ti_3Al$.

In the same way, the mechanical properties of those compounds are completely inadequate for industrial applications. At low temperatures they have virtually no ductility, and at enhanced temperatures they have inadequate creep resistance or limiting creep stress.

It is accordingly an object of the invention to provide a high-temperature, creep-resistant material, which overcomes the hereinafore-mentioned disadvantages of the heretofore-known devices of this general type and which has both the desired mechanical properties and the required corrosion resistance.

SUMMARY OF THE INVENTION

With the foregoing and other objects in view there is provided, in accordance with the invention, a high-temperature, creep-resistant material comprising intermetallic compounds in a titanium/aluminum system, containing from 44 to 73 atom % titanium, from 19 to 35 atom % aluminum, from 2 to 6 atom % silicon, and from 5 to 15 atom % niobium.

The alloy is heat treated at a temperature of between 800° and 1100° . This leads to the desired microstructure.

Accordingly, a $Ti_3Al$ base alloy having a titanium content of 44–73 atom % and an aluminum content of 19–35 atom % has its oxidation resistance considerably enhanced by alloying silicon (from 2 to 6 atom %) and niobium (from 5 to 15 atom %). The specified alloy has a eutectic microstructure which is important in terms of their strength. The silicon additions specified result in the formation of $Ti_5Si_3$ precipitates and at the same time in a considerable reduction of the oxidation rate combined with increased adhesion of the oxide layer. Increased silicon contents considerably above the 6% range show primary solidified $(Ti, Nb)_5$ (Si, Al) needles, which cause deterioration of ductility and fracture toughness. The niobium additions specified above, especially in combination with silicon, produce a further reduction of the oxidation rate combined with increased oxide adhesion. The additions of silicon and niobium lead to a reduced proportion of titanium dioxide ($TiO_2$) in the oxide layer, wherein the titanium dioxide, because of its high intrinsic disorder, has a high growth rate.

At the same time, alloying silicon and niobium leads to the formation of a two-phase microstructure which has distinctly improved high-temperature strength and limiting creep stress, as compared to the $Ti_3Al$ base alloy.

In accordance with another feature of the invention, the silicon and niobium are supplemented or replaced by alloying chromium, tantalum, tungsten, molybdenum or vanadium or combinations of these elements. Possible alloy contents are from 1 to 20 atom % chromium, from 1 to 10 atom % tantalum, and from 0.1 to 5 atom % tungsten, molybdenum and vanadium.

The formation of dense, protective oxide layers is particularly important for the titanium aluminides, since they prevent oxygen and nitrogen from penetrating into the core matrix and thus prevent the embrittlement thereof. In order to stem the diffusion of dissolved oxygen and nitrogen, or at least to reduce it significantly, in accordance with a further feature of the invention, there is provided an addition of so-called reactive elements such as, for example, yttrium, hafnium, erbium and lanthanum and other rare earths or combinations of these elements. On one hand, these oxides and nitrides are thermodynamically considerably more stable than those of titanium. On the other hand, these elements at the same time produce an increase in the oxidation resistance of the intermetallic compounds specified.

Producing and working the high-temperature materials according to the invention does not present any particular difficulties, but may be carried out according to the conventional processes employed with materials of this type, for example by precision casting, directed solidification, or by powder-metallurgical methods.

In accordance with an added feature of the invention, the high-temperature material is produced with the addition of oxides of the previously mentioned reactive elements by mechanical alloying, in order to obtain especially heat-resistant intermetallic compounds.

In accordance with a concomitant feature of the invention, there is provided an addition of boron (from 0.05 to 5 atom %) or carbon or nitrogen (from 0.05 to 1 atom %), or combinations of these elements, in order to achieve a further improvement in the mechanical properties and a close-grained microstructure. This is achieved by the additions of boron, carbon and nitrogen resulting in the formation of stable borides, carbides and nitrides or carbonitrides.

The last-mentioned additions of boron, carbon and nitrogen are of special significance in connection with the directed solidification of these intermetallic compounds, as a result of which the precipitation of highly extended compounds, such as of borides, silicides and similar strength-enhancing compounds, for example, is effected.

Some examples of applications which may be mentioned for the invention are:

1. high-performance turbine blades for industrial gas turbines and aircraft engines; and
2. compressor rotors for turbochargers.

The alloys mentioned above can be used for highly stressed components such as gas turbine blades in stationary gas turbines or aircraft engines as well as for compressor impellers for turbochargers in diesel engines, for example.

Other features which are considered as characteristic for the invention are set forth in the appended claims.

Although the invention is described herein as embodied in a high-temperature, creep-resistant material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the following examples of processes according to which the components can be manufactured, in principle.

Investment casting analogous to titanium alloys

A rod-shaped electrode, which is a base material for the casting and has a composition according to the patent claims of the instant application, is flashed under vacuum into molds by means of arc melting. The melt flows into the mold which has a temperature that can be between room temperature and 1200° C. During casting the molds may be fixed so as to be at rest or may rotate about an axis of rotation. After casting and cooling of the workpiece, the mold is removed, the component is heat-treated, preferably between 800° and 1100° C., machined mechanically or chemically and used as a turbine blade for diffuser blades and impeller blades.

This manufacture is carried out in analogy to turbine blades being formed of nickel-based alloys used to date.

PM Manufacture

Powder-metallurgical processes are alternative manufacturing methods to casting, which are preferably used in those cases where particularly stringent requirements apply regarding homogeneous composition and narrow tolerances with respect to the particle sizes of the microstructure. Using this process, it is likewise possible to manufacture complex-shaped components such as turbine blades or turbocharger rotors, for example, according to the manufacturing technologies known for other materials. In the case of the titanium aluminides it is only necessary, when preparing the powders, to ensure low oxygen and nitrogen contents, which can be achieved by atomization in vacuum or under protective gas when preparing the powder.

The components manufactured from titanium aluminides according to these processes are preferably used for rotating components such as, for example, rotor blades in stationary gas turbines and aircraft engines, since they nearly halve centrifugal forces and increase the service life of rotors as a result of their low density (only about 50% of the density of nickel-based alloys). In aircraft engines the weight savings associated with using these components plays an important additional part, since the fuel consumption of the engine can be reduced. In the case of turbocharger rotors, the low density of the material achieves short response times of the compressor rotor to rapid load changes.

We claim:

1. A high-temperature, creep-resistant material comprising intermetallic compounds in a titanium/aluminum system, containing from 44 to 73 atom % titanium, from 19 to 35 atom % aluminum, from 2 to 6 atom % silicon, and from 5 to 15 atom % niobium.

2. The high-temperature, creep-resistant material according to claim 1, including from 1 to 5 atom % of a material selected from the group consisting of tungsten, molybdenum and vanadium.

3. The high-temperature, creep-resistant material according to claim 1, including from 0.05 to 2 atom % up to a maximum total of 3 atom % of an admixed material selected from the group consisting of yttrium, hafnium, erbium and lanthanum.

4. The high-temperature, creep-resistant material according to claim 1, including from 0.05 to 2 atom % up to a maximum total of 3 atom % of a material selected from the group consisting of yttrium, hafnium, erbium and lanthanum, being admixed by mechanical alloying.

5. The high-temperature, creep-resistant material according to claim 1, including from 0.05 to 5 atom % boron.

6. The high-temperature, creep-resistant material according to claim 1, including from 0.05 to 1 atom % of an admixed material selected from the group consisting of carbon and nitrogen.

7. The high-temperature, creep-resistant material according to claim 5, including from 0.05 to 1 atom % of an admixed material selected from the group consisting of carbon and nitrogen.

* * * * *